US011820569B2

(12) United States Patent
Gonzalez Manzano

(10) Patent No.: US 11,820,569 B2
(45) Date of Patent: Nov. 21, 2023

(54) CARRIER FOR CONTAINERS

(71) Applicant: Graphic Packaging International, LLC, Atlanta, GA (US)

(72) Inventor: Ana Maria Gonzalez Manzano, Igualada (ES)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/690,208

(22) Filed: Mar. 9, 2022

(65) Prior Publication Data

US 2022/0289445 A1 Sep. 15, 2022

Related U.S. Application Data

(60) Provisional application No. 63/159,619, filed on Mar. 11, 2021.

(51) Int. Cl.
*B65D 71/42* (2006.01)
*B65B 17/02* (2006.01)

(52) U.S. Cl.
CPC ..... *B65D 71/42* (2013.01); *B65B 17/025* (2013.01); *B65D 2571/0066* (2013.01); *B65D 2571/00567* (2013.01)

(58) Field of Classification Search
CPC ..... B65B 17/025; B65D 71/00; B65D 71/34; B65D 71/36; B65D 71/42; B65D 2571/00567; B65D 2571/0066
USPC ..... 206/145, 152, 153, 161, 427
See application file for complete search history.

(56) References Cited

U.S. PATENT DOCUMENTS 3,700,275 A * 10/1972 Deasy ..... B65D 71/506 206/196
4,415,082 A 11/1983 Martin
4,441,611 A * 4/1984 Sommariva ..... B65D 71/0085 206/460
6,981,631 B2 1/2006 Fogle et al.
7,380,701 B2 6/2008 Fogle et al.
8,356,744 B2 1/2013 Brand et al.
8,387,784 B2 3/2013 Gonzalez et al.
8,439,253 B2 5/2013 Requena et al.
8,459,533 B2 6/2013 Requena et al.
8,496,109 B2 7/2013 Smalley et al.
8,602,209 B2 12/2013 Jones et al.
8,740,051 B2 6/2014 Gonzalez
8,978,889 B2 3/2015 Fitzwater et al.
(Continued)

FOREIGN PATENT DOCUMENTS

EP 0060504 B1 11/1984
GB 2170774 A * 8/1986 ..... B65B 17/025
(Continued)

OTHER PUBLICATIONS

International Search Report and Written Opinion for PCT/US2022/019443 dated Jul. 4, 2022.

*Primary Examiner* — Bryon P Gehman
(74) *Attorney, Agent, or Firm* — WOMBLE BOND DICKINSON (US) LLP

(57) ABSTRACT

A carrier for holding a plurality of containers includes a plurality of panels including a top panel foldably connected to at least one attachment panel, and attachment features for attaching the carrier to the plurality of containers and for selectively separating one or more containers from the carrier.

44 Claims, 13 Drawing Sheets

(56) References Cited

U.S. PATENT DOCUMENTS

| | | | |
|---|---|---|---|
| 9,033,209 | B2 | 5/2015 | Fogle et al. |
| 9,073,658 | B2 | 7/2015 | Spivey, Sr. et al. |
| 9,174,763 | B2 | 11/2015 | Smalley et al. |
| 9,211,971 | B2 | 12/2015 | Fogle et al. |
| 9,248,933 | B2 | 2/2016 | Spivey, Sr. et al. |
| 9,321,553 | B1 | 4/2016 | Spivey, Sr. et al. |
| 9,352,890 | B2 | 5/2016 | Alexander et al. |
| 9,446,891 | B2 | 9/2016 | Jones et al. |
| 9,850,023 | B2 | 12/2017 | Gonzalez |
| 10,029,837 | B2 | 7/2018 | Alexander et al. |
| D826,711 | S | 8/2018 | Boersma et al. |
| 10,202,228 | B2 | 2/2019 | Boersma et al. |
| 10,207,848 | B2 | 2/2019 | Alexander et al. |
| 10,214,334 | B2 | 2/2019 | Jones et al. |
| 10,543,969 | B2 | 1/2020 | Gonzalez et al. |
| D887,831 | S | 6/2020 | Boersma et al. |
| D887,832 | S | 6/2020 | Boersma et al. |
| 10,858,145 | B2 | 12/2020 | Spivey, Sr. et al. |
| D946,417 | S | 3/2022 | Gonzalez Manzano et al. |
| D946,418 | S | 3/2022 | Gonzalez Manzano et al. |
| D946,419 | S | 3/2022 | Gonzalez Manzano et al. |
| D946,420 | S | 3/2022 | Gonzalez Manzano et al. |
| D946,421 | S | 3/2022 | Gonzalez Manzano et al. |
| 11,286,094 | B2 | 3/2022 | Gonzalez Manzano et al. |
| D955,889 | S | 6/2022 | Gonzalez Manzano et al. |
| D955,890 | S | 6/2022 | Gonzalez Manzano et al. |
| D956,573 | S | 7/2022 | Gonzalez Manzano et al. |
| D956,574 | S | 7/2022 | Gonzalez Manzano et al. |
| D956,575 | S | 7/2022 | Gonzalez Manzano et al. |
| 11,383,907 | B2 | 7/2022 | Gonzalez Manzano et al. |
| 2007/0007158 | A1 | 1/2007 | Cordes et al. |
| 2018/0297744 | A1 | 10/2018 | Merzeau |

FOREIGN PATENT DOCUMENTS

| | | | | |
|---|---|---|---|---|
| GB | 2224257 A | * | 5/1990 | ..... B65D 71/42 |
| KR | 10-1269791 B1 | | 6/2013 | |

* cited by examiner

CARRIER FOR CONTAINERS

CROSS-REFERENCE TO RELATED APPLICATION

This application claims the benefit of U.S. Provisional Patent Application No. 63/159,619, filed on Mar. 11, 2021.

INCORPORATION BY REFERENCE

The disclosure of U.S. Provisional Patent Application No. 63/159,619, filed on Mar. 11, 2021, is hereby incorporated by reference for all purposes as if presented herein in its entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a plurality of panels comprising a top panel foldably connected to at least one attachment panel, and attachment features for attaching the carrier to the plurality of containers and for selectively separating one or more containers from the carrier.

According to another aspect, the disclosure is generally directed to a blank for forming a carrier for holding a plurality of containers, the blank comprising a plurality of panels comprising a top panel foldably connected to at least one attachment panel, and attachment features for attaching the carrier formed from the blank to the plurality of containers and for selectively separating one or more containers from the carrier formed from the blank.

According to another aspect, the disclosure is generally directed to a package comprising a plurality of panels comprising a top panel foldably connected to at least one attachment panel, and attachment features attaching the carrier to the plurality of containers such that one or more containers are selectively separable from the carrier.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to carriers, packages, constructs, sleeves, cartons, or the like, for holding and displaying containers such as jars, bottles, cans, etc. In one embodiment, the containers can be brick-shaped containers commonly referred to as TETRA PAK© containers that contain a liquid beverage or other food or beverage product. The containers C can be any suitable container such as any shape, size, and type of container that is commercially available from Tetra Pak International SA, Lausanne, Switzerland, such as TETRA BRIK packages, TETRA BRIK ASEPTIC packages, TETRA PRISM ASEPTIC packages, or any other suitable package or container (see www.tetrapak.com for more information). The containers C could be other suitable containers made from other materials by other manufactures (e.g., PET bottles, yogurt containers, juice-boxes, beverage cans, etc.), and such materials can include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes, sizes, numbers, and/or configurations. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
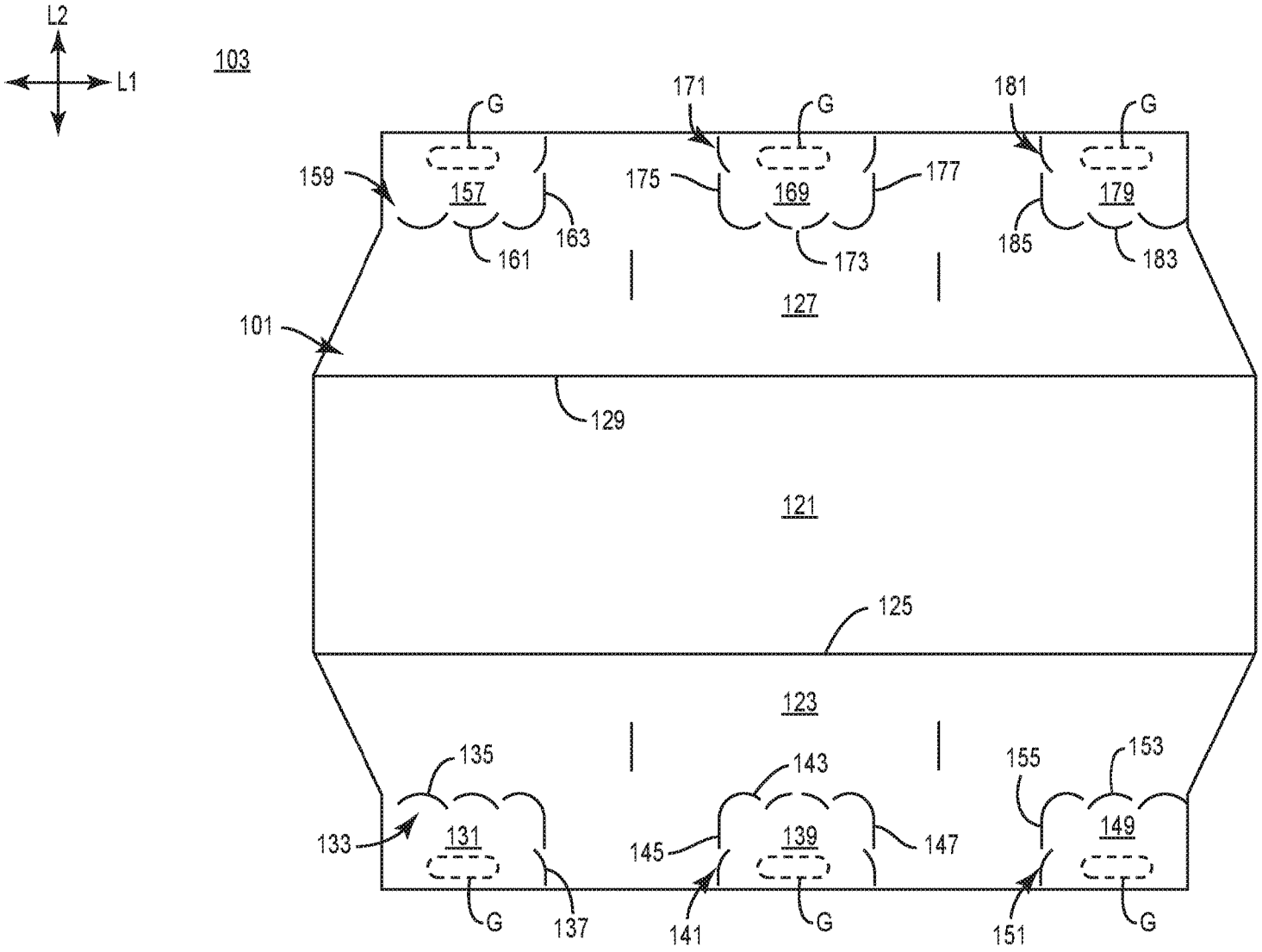
FIG. 1 is a plan view of an outer surface of a blank for forming a carrier and package according to a first exemplary embodiment of the disclosure.
Figure 3:
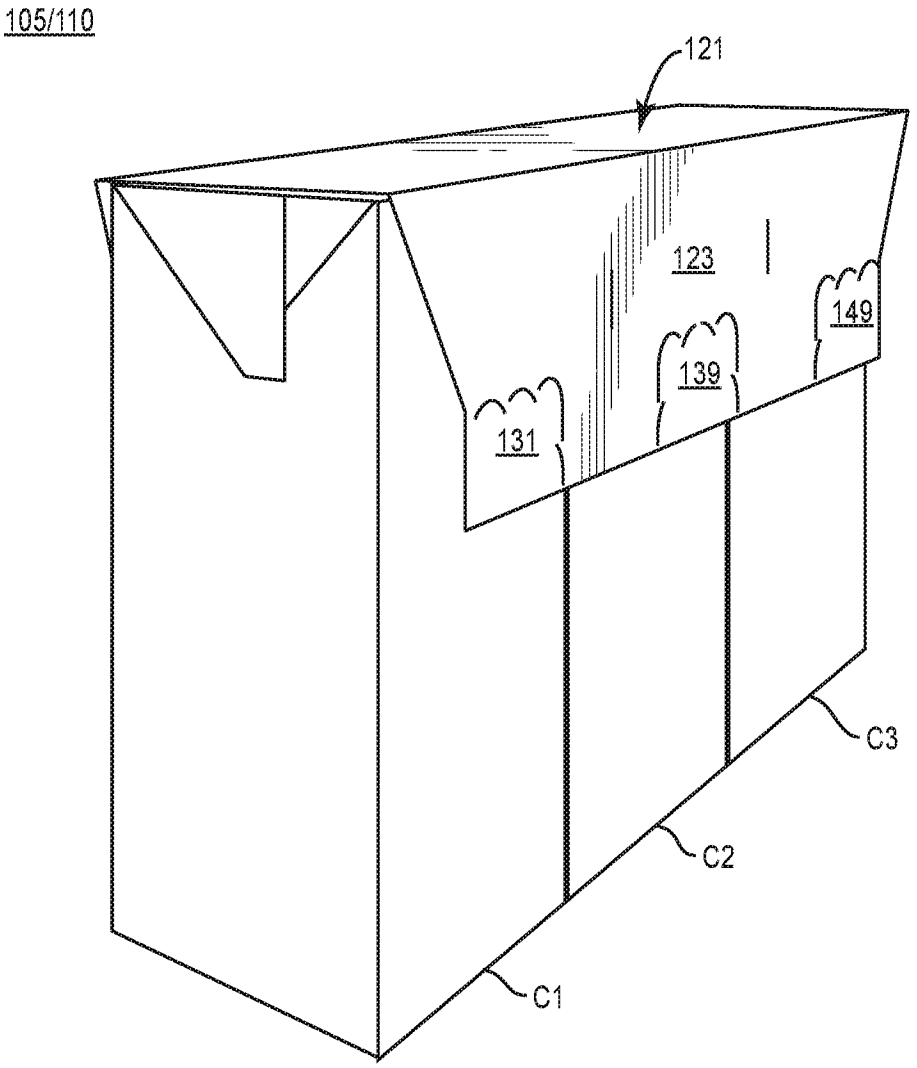
FIG. 3 is a perspective view of the package and carrier formed from the blank of FIG. 1 according to the first exemplary embodiment of the disclosure.

FIG. 1 shows a plan view of an exterior side 101 of a blank 103 used to form a carrier 105 (FIG. 3) in accordance with a first exemplary embodiment of the disclosure. As shown in FIG. 3, the carrier 105 is sized to contain or support three containers C1, C2, C3. In the illustrated embodiment, the containers C1, C2, C3 can be beverage containers in the form of aseptic bricks or other box-shaped containers, or could be any other suitable type and size of container without departing from the disclosure. It will be understood that the carrier 105 can carry more or less than three containers without departing from the disclosure. The carrier 105 can be provided together with one or more of the containers as a package 110.

As shown in FIG. 1, the blank 103 has a longitudinal axis L1 and a lateral axis L2. The blank 103 has a plurality of panels for at least partially extending around the containers C1, C2, C3, and includes a central panel or top panel 121, a first attachment panel or front attachment panel 123 foldably connected to the top panel 121 at a longitudinal fold line 125, and a second attachment panel or back attachment panel 127 foldably connected to the top panel 121 at a longitudinal fold line 129.

The blank 103/carrier 105 can also have attachment features for releasably attaching the containers C1, C2, C3 to the blank 103/carrier 105. As shown, a first outer attachment tab 131 can be at least partially defined by a tear line/line of weakening 133 in the attachment panel 123 and having a longitudinal portion 135 intersecting a lateral portion 137, with the longitudinal portion 135 extending to and intersecting a lateral free edge (broadly, "first free edge") of the attachment panel 123 and with the lateral portion 137 extending to and intersecting a longitudinal free edge (broadly, "second free edge") of the attachment panel 123. A central attachment tab 139 can be at least partially defined by a tear line/line of weakening 141 in the attachment panel 123 and having a longitudinal portion 143 intersecting a pair of lateral portions 145, 147 each extending to a longitudinal free edge of the attachment panel 123. A second outer attachment tab 149 can be at least partially defined by a tear line/line of weakening 151 in the attachment panel 123 and having a longitudinal portion 153 intersecting a lateral portion 155, with the longitudinal portion 153 extending to and intersecting a lateral free edge of the attachment panel 123 and with the lateral portion 155 extending to and intersecting a longitudinal free edge of the attachment panel 123.

Similarly, a first outer attachment tab 157 can be at least partially defined by a tear line/line of weakening 159 in the attachment panel 127 and having a longitudinal portion 161 intersecting a lateral portion 163, with the longitudinal portion 161 extending to and intersecting a lateral free edge of the attachment panel 127 and with the lateral portion 163 extending to and intersecting a longitudinal free edge of the attachment panel 127. A central attachment tab 169 can be at least partially defined by a tear line/line of weakening 171 in the attachment panel 127 and having a longitudinal portion 173 intersecting a pair of lateral portions 175, 177 each extending to a free edge of the attachment panel 127. A second outer attachment tab 179 can be at least partially defined by a tear line/line of weakening 181 in the attachment panel 127 and having a longitudinal portion 183 intersecting a lateral portion 185, with the longitudinal portion 183 extending to and intersecting a lateral free edge of the attachment panel 127 and with the lateral portion 185 extending to and intersecting a longitudinal free edge of the attachment panel 127.

Figure 2:
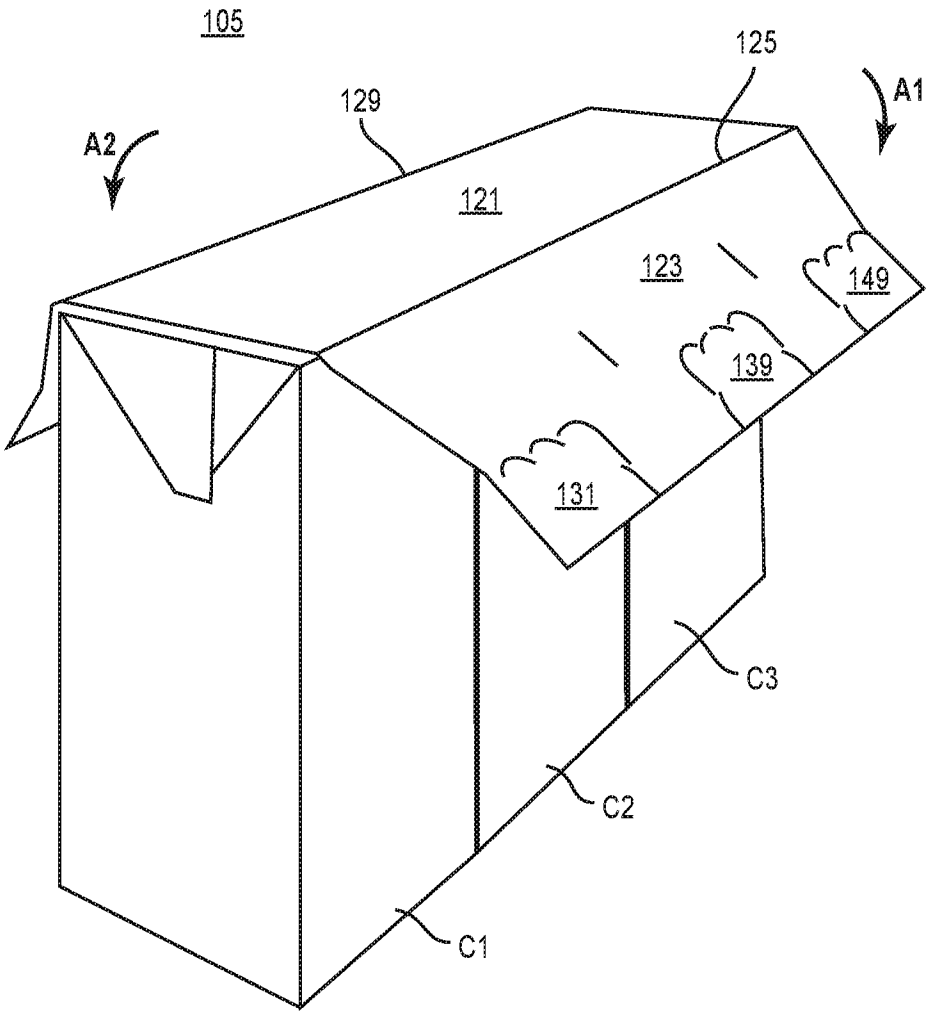
FIG. 2 is a perspective view of a partially formed configuration of a package and carrier formed from the blank of FIG. 1 according to the first exemplary embodiment of the disclosure.

Referring to FIGS. 2 and 3, the carrier 105/package 110 can be formed by positioning the top panel 121 across top portions of the containers C1, C2, C3 and folding the attachment panels 123, 127 at the respective fold lines 125, 129 in the direction of the respective arrows A1, A2.

In this regard, at least a portion of each of the top panel 121, the front attachment panel 123, and the back attachment panel 127 can be positioned in at least partial face-to-face contact with respective containers. Such an arrangement can be maintained with an adhesive, such as glue G (FIG. 1), so that at least the attachment panels 123, 127 are attached to the respective containers. As shown in FIG. 1, the one or more applications of glue G can be disposed on one or more of the attachment tabs 131, 139, 149, 157, 169, 179 along an interior surface of the blank 103. It will be understood that adhesive can additionally or alternatively be applied to other portions of the attachment panel 123, the attachment panel 127, the top panel 121, and/or the containers C1, C2, C3.

Figure 4:
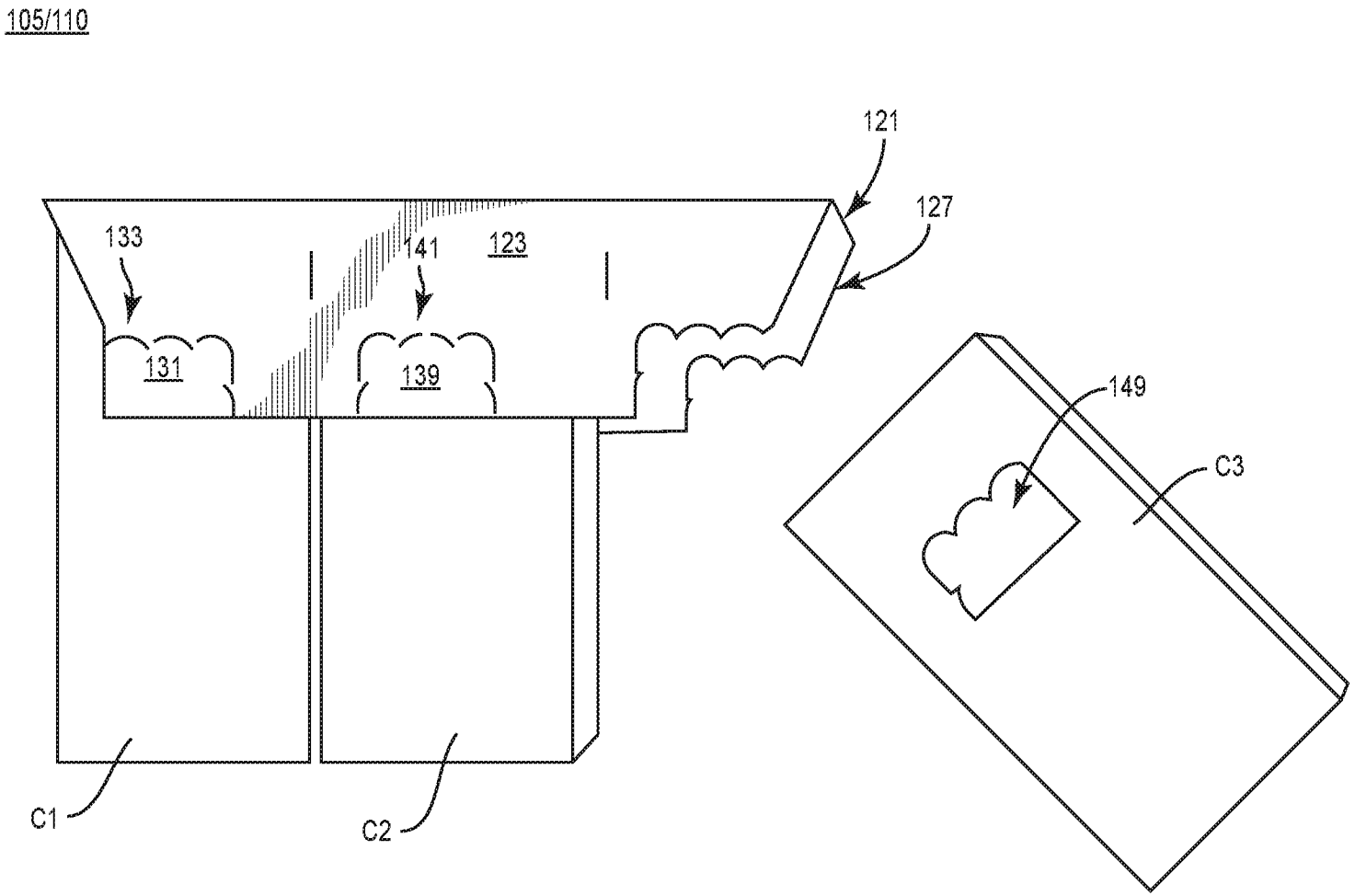
FIG. 4 is a perspective view of a container being separated from the carrier and package of FIG. 4 according to the first exemplary embodiment of the disclosure.

With additional reference to FIG. 4, when it is desired to remove one or more of the containers C1, C2, C3 from the carrier 105/package 110, such container can be grasped by a customer and pulled away from the carrier 105/package 110 with a force sufficient to cause separation of a respective pair of attachment tabs 131, 157; 139, 169; 149, 179 from the respective attachment flaps 123, 137 at the respective lines of weakening 133, 159; 141, 171; 151, 181. Such removal of the respective container and pair of attachment tabs from the remainder of the carrier 105/package 110 can also include the separation of a top portion of the respective container from the top panel 121.

In this regard, each container removed from the carrier 105/package 110 can be provided with a respective pair of attachment tabs 131, 157; 139, 169; 149, 179 attached to opposing (e.g., front and back) surfaces thereof, and which can optionally be removed thereafter by a customer.

The aforementioned arrangement of the carrier 105/package 110 provides attachment features for the containers C1, C2, C3 that are configured for the selective release/separation of respective containers from the carrier 105/package 110. In this regard, the attachment tabs 131, 139, 149, 157, 169, 179 can be considered both attachment features and separation features of the blank 103/carrier 105/package 110. In one embodiment, the attachment tabs 131, 139, 149, 157, 169, 179 can be attachment features of the blank 103/carrier 105/package 110, and the lines of weakening 133, 141, 151, 159, 171, 181 and associated portions can be separation features of the blank 103/carrier 105/package 110.

As described above, the removal of the respective containers in this manner is accomplished through a controlled tearing of pair of attachment tabs 131, 157; 139, 169; 149, 179 from the respective attachment panels 123, 127 that can, for example, involve the use of a predetermined tearing force from the customer sufficient to avoid inadvertent separation of the containers, e.g., due to incidental movement by the customer or during transport. In addition, the attachment features of the carrier 105/package 110 can provide visual evidence of alteration to the carrier 105/package 110, e.g., by providing interrupted surfaces with of the respective panels 123, 127 along which perforated/torn edges are defined, so as to provide tamper evident/tamper evidencing features to the carrier 105/package 110.

Figure 5:
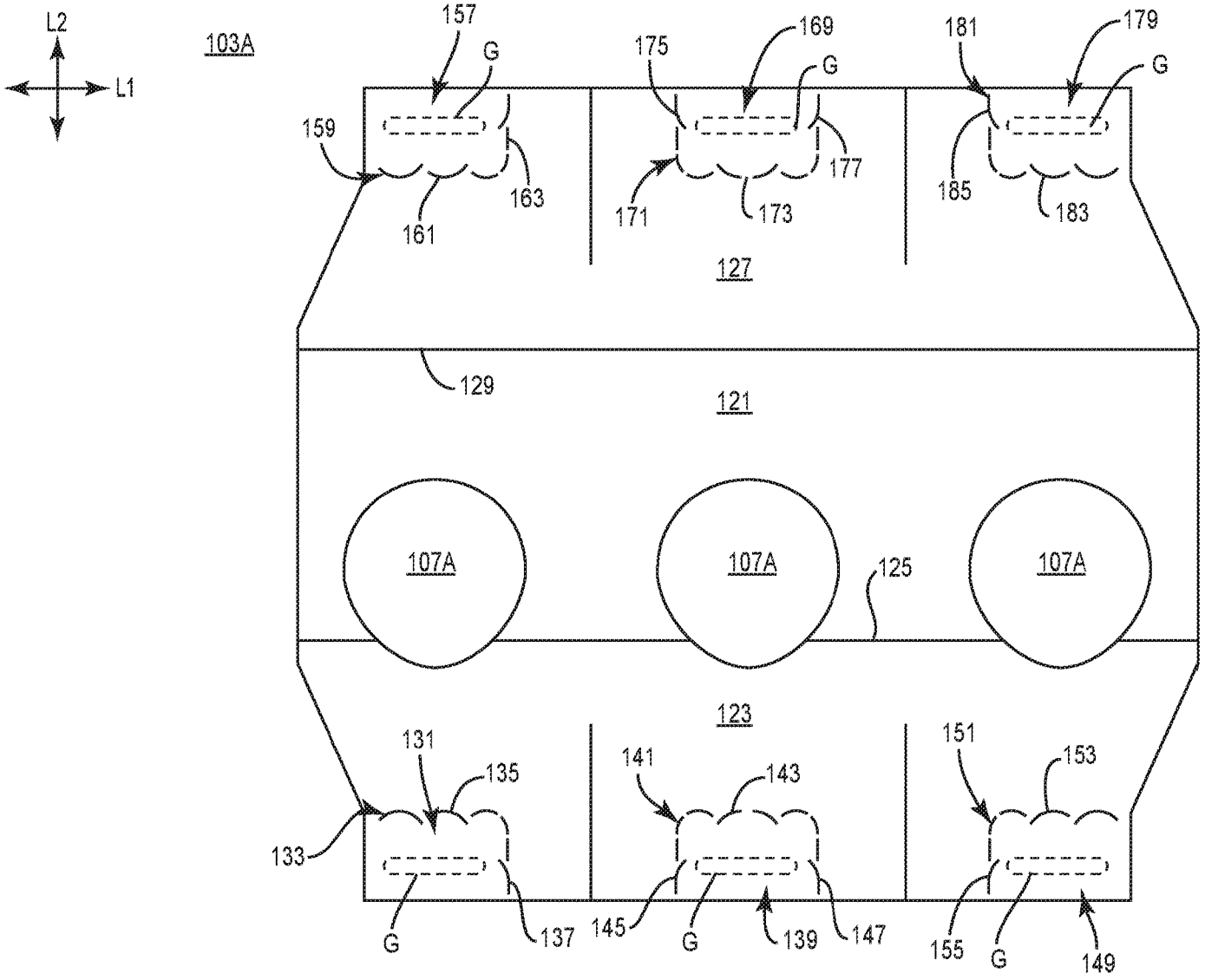
FIG. 5 is a plan view of an outer surface of a blank for forming a carrier and package according to an alternative configuration of the first exemplary embodiment of the disclosure.

Referring to FIG. 5, a blank for forming a carrier 105A/package 110A according to an alternative configuration to that of the first exemplary embodiment is generally designated 103A. The blank 103A is generally similar to the blank 103 described above, except that the blank 103A includes a plurality of container receiving openings 107A at least partially defined in the top panel 121 and at least partially extending into the front attachment panel 123 so as to interrupt the fold line 125.

Figure 6:
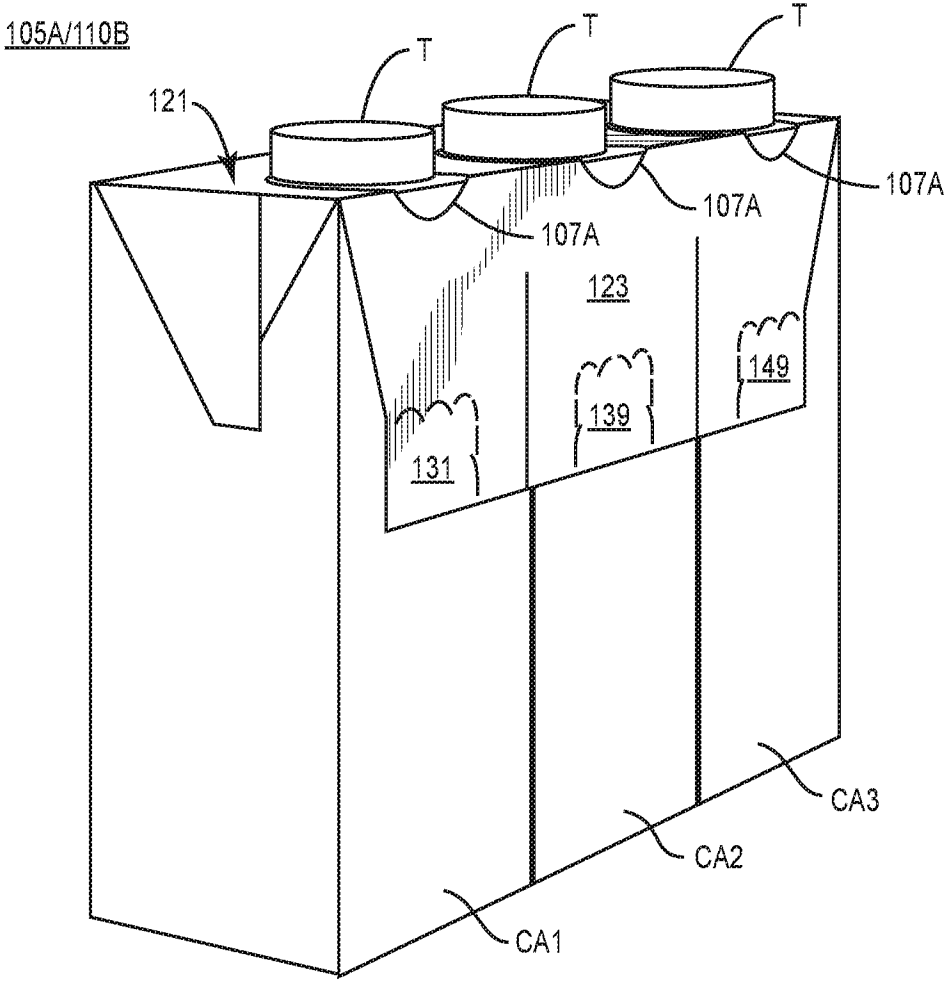
FIG. 6 is a perspective view of the package and carrier formed from the blank of FIG. 5 according to the alternative configuration of the first exemplary embodiment of the disclosure.

With additional reference to FIG. 6, a carrier 105A/package 110A can be formed in a manner similar to that described above with regard to the carrier 105/package 110, and can be attached to respective containers CA1, CA2, CA3. The containers CA1, CA2, CA3 can be generally similar to the containers C1, C2, C3 described above, in one example, aseptic bricks, but can include having a protruding upper portion including a cap T.

As shown, the top panel 121 can be arranged overlying top portions of the containers CA1, CA2, CA3 and with the attachment panels 123, 127 in at least partial face-to-face contact with respective surfaces of the containers CA1, CA2, CA3. As shown, the container receiving openings 107A can be sized and configured and positioned to at least partially receive the caps T protruding upwardly from the respective containers CA1, CA2, CA3, and/or another upwardly protruding structure such as a neck, a spout, etc.

The carrier 105A/package 110A can provide selective separation of respective containers CA1, CA2, CA3 via the separation of a pair of attachment tabs 131, 157; 139, 169; 149, 179 as discussed above, and can provide similar advantages as described above with regard to the carrier 105/package 110.

Figure 7:
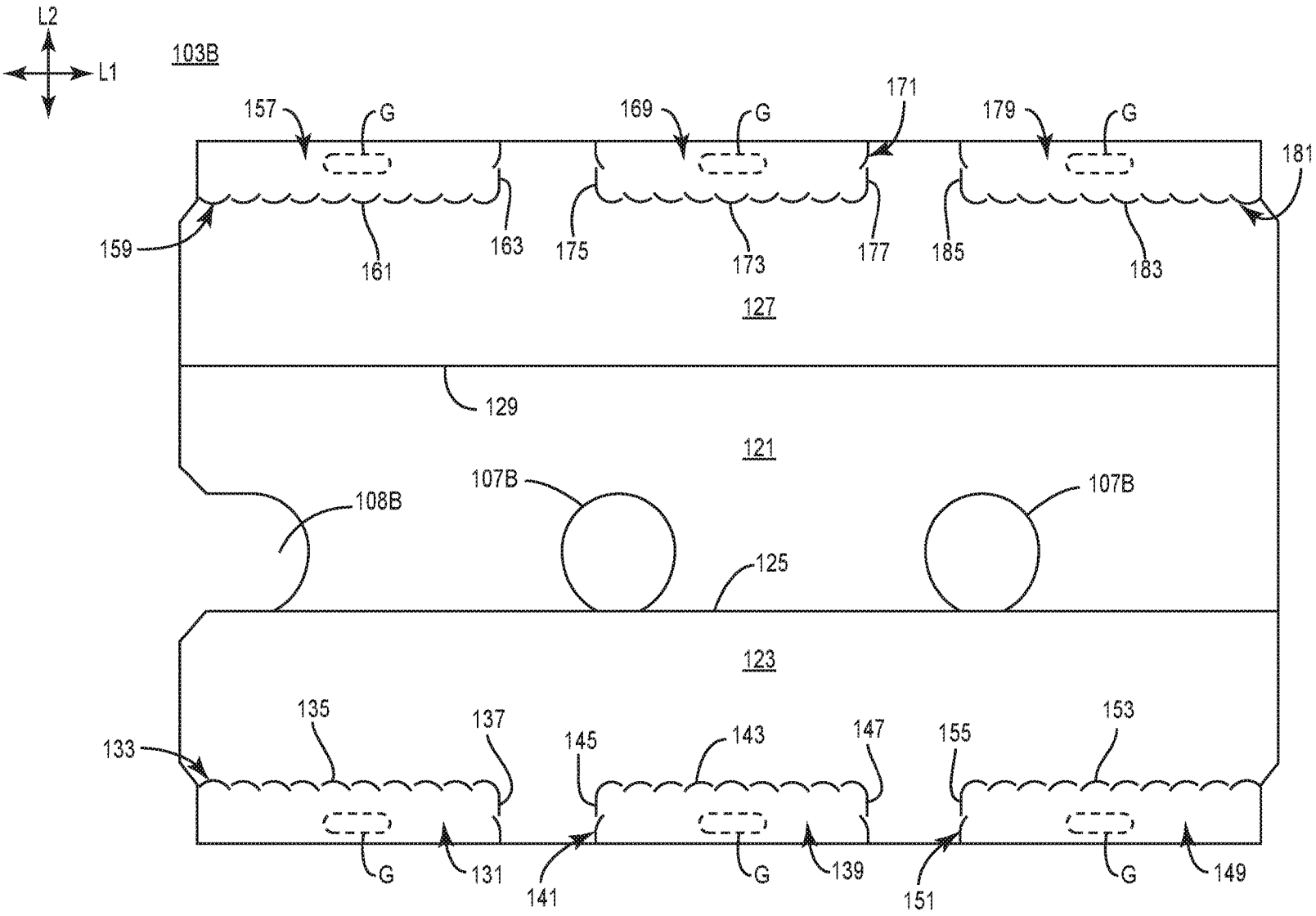
FIG. 7 is a plan view of an outer surface of a blank for forming a carrier and package according to another alternative configuration of the first exemplary embodiment of the disclosure.

Turning to FIG. 7, a blank for forming a carrier 105B/package 110B according to another alternative configuration to that of the first exemplary embodiment is generally designated 103B. As shown, the blank 103B is generally similar to the blanks 103, 103A described above, and includes a plurality of container receiving openings 107B at least partially defined in the top panel 121 and interrupting the fold line 125. In one embodiment, the container receiving openings 107B can extend at least partially into the front attachment panel 123.

As also shown, the blank 103 can include one or more container receiving notches 108B formed/defined along a lateral free edge of the top panel 121. In this regard, the container receiving opening 107B and the container receiving notch 108B can be configured for at least partially receiving a protruding upper portion of containers that are offset from their respective centers, e.g., containers with caps, necks, pouring spouts, etc.

Figure 8:
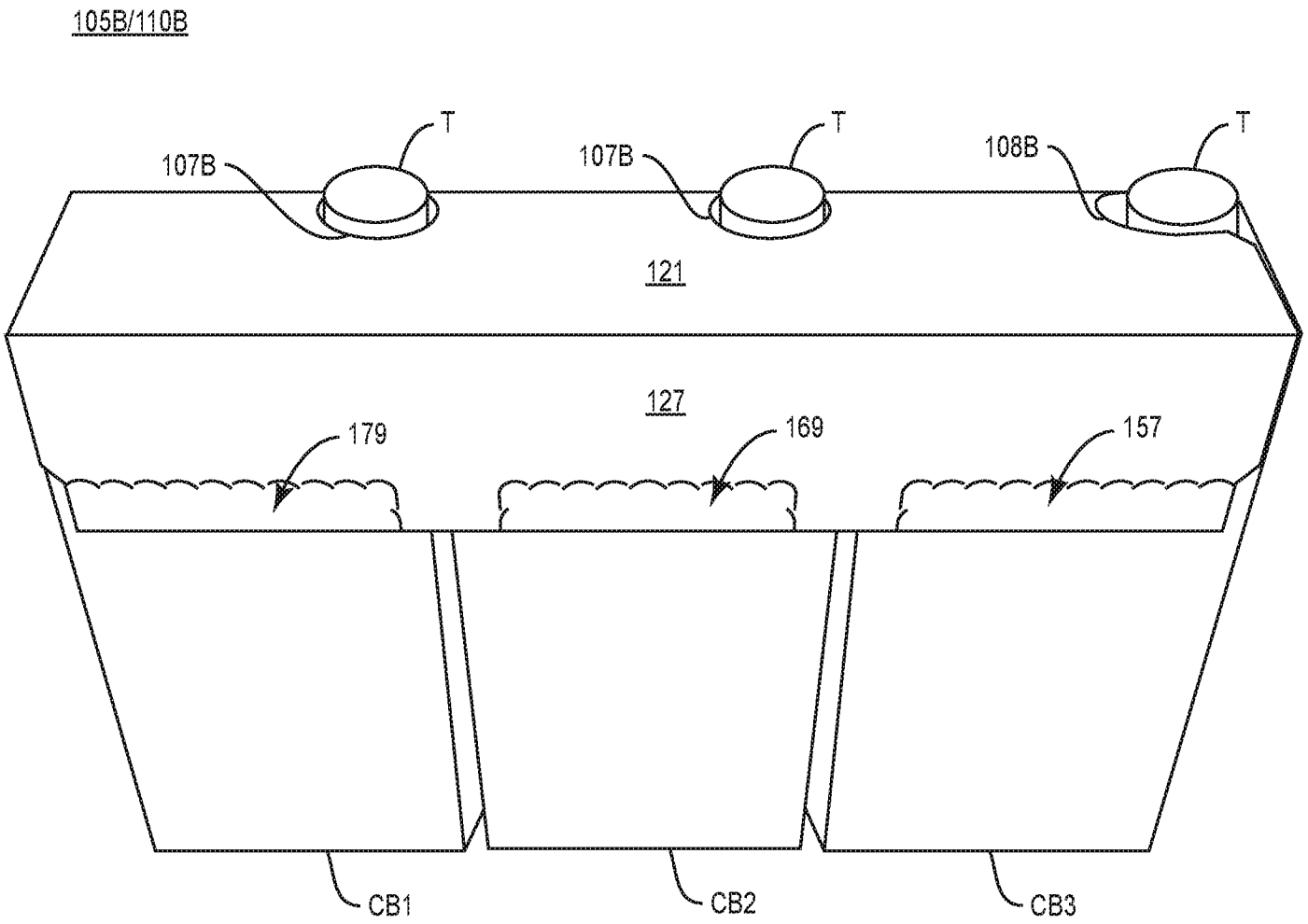
FIG. 8 is a perspective view of the package and carrier formed from the blank of FIG. 7 according to the alternative configuration of the first exemplary embodiment of the disclosure.

With additional reference to FIG. 8, the carrier 105B/package 110B can be formed in a substantially similar manner to that described above with regard to the carriers 105, 105A, and can be attached to respective containers CB1, CB2, CB3. The containers CB1, CB2, CB3 can be similar to the respective containers CA1, CA2, CA3 described above, for example, aseptic bricks having upwardly protruding portions, but the containers CB1, CB2, CB3 have respective caps T positioned offset from a center of the top surface of the respective containers CB1, CB2, CB3.

The top panel 121 can be positioned overlying the containers CB1, CB2, CB3 and the attachment panels 123, 127 can be folded downwardly at the respective fold lines 125, 129 into at least partial face-to-face contact with the containers CB1, CB2, CB3. During such formation of the carrier 105B/package 110B, upper portions of the respective containers CB1, CB2, CB3 can be at least partially received through the respective container receiving openings 107B and container receiving notch 108B.

The carrier 105B/package 110B can provide selective separation of respective containers CB1, CB2, CB3 via the separation of a pair of attachment tabs 131, 157; 139, 169; 149, 179 as discussed above, and can provide similar advantages as described above with regard to the carriers 105, 105A and packages 110, 110A.

Figure 9:
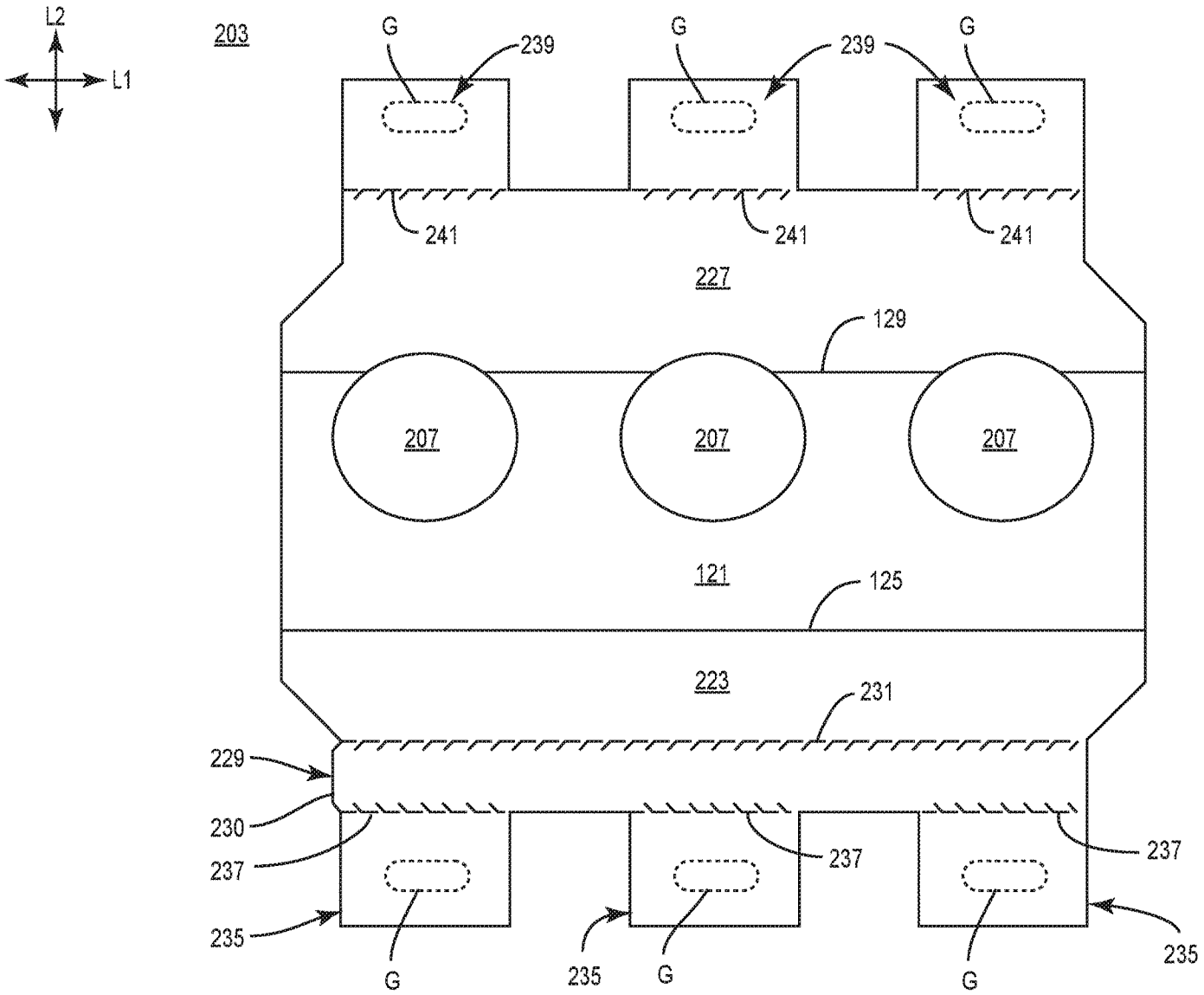
FIG. 9 is a plan view of an outer surface of a blank for forming a carrier and package according to a second exemplary embodiment of the disclosure.

Turning to FIG. 9 a blank for forming a carrier 205 (FIG. 10) according to a second exemplary embodiment of the disclosure is generally designated 203. The blank 203 and the carrier 205 formed therefrom can have one or more features similar to those described above with regard to the blanks 103, 103A, 103B and carriers 105, 105B, and like or similar features are designated with like or similar reference numerals. The carrier 205 can be provided with one or more containers as a package 210.

As shown, the blank 203 can have the longitudinal axis L1 and the lateral axis L2, and can include the top panel 121, a front panel or attachment panel 223 foldably connected to the top panel 121 at the fold line 125, and a back panel or back attachment panel 227 foldably connected to the top panel 121 at the fold line 129. Container receiving openings 207 can be at least partially defined in the top panel 121 so as to interrupt the fold line 129, and can at least partially extend into the back attachment panel 227.

Attachment features and/or separation features of the blank 203/carrier 205 can also include a tear strip 229 separably connected to the front attachment panel 223 at a longitudinal line of weakening 231. In one embodiment, the tear strip 229 can include a user engagement feature 230 in the form of a portion thereof that protrudes past an adjacent portion of the attachment panel 223.

Attachment tabs 235, as shown, can be separably connected to the tear strip 229 at respective lines of weakening 237. As shown, attachment tabs 239 can also be separably attached to the back attachment panel 227 at respective longitudinal lines of weakening/tear lines 241.

Figure 10:
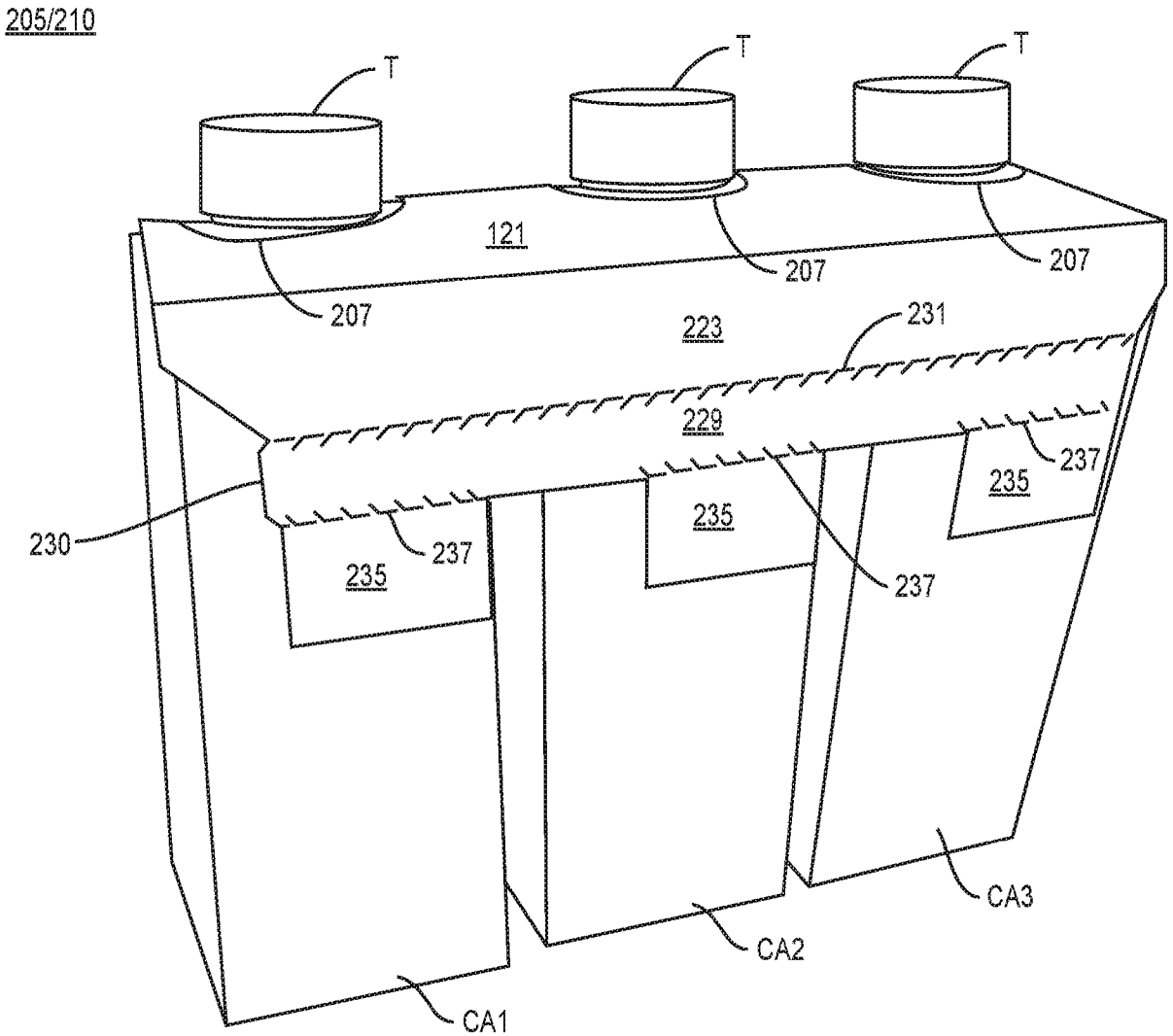
FIG. 10 is a perspective view of the package and carrier formed from the blank of FIG. 9 according to the second exemplary embodiment of the disclosure.
Figure 11:
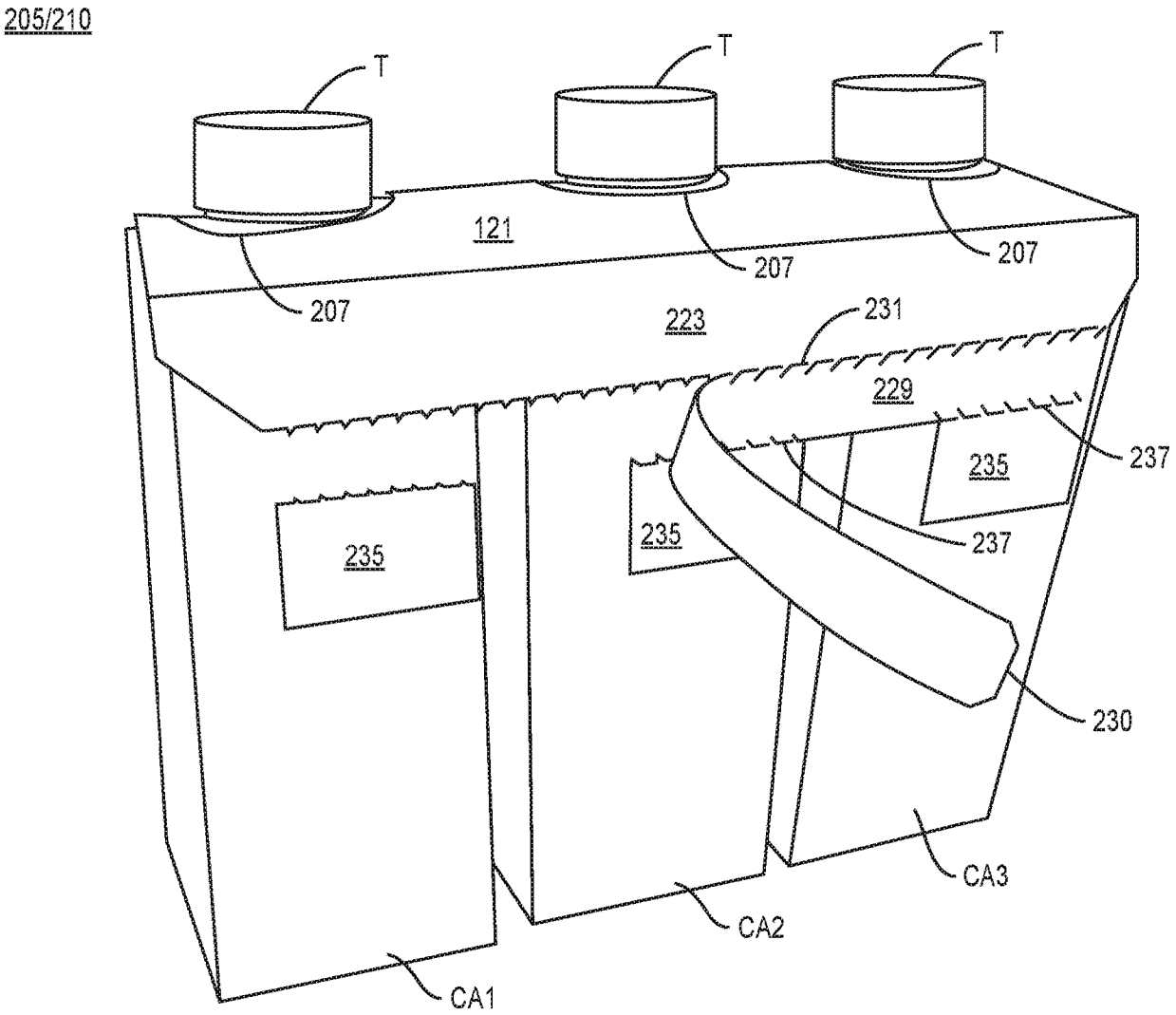
FIG. 11 is a perspective view of a container being separated from the carrier and package of FIG. 10 according to the second exemplary embodiment of the disclosure.

With reference to FIGS. 10 and 11, the carrier 205/package 210 can be formed in a similar manner to that described above with regard to the carriers 105, 105B, e.g., the top panel 121 can be positioned over the containers CAL CA2, CA3 so that the container receiving openings 207 at least partially receive upper portions T thereof, and the attachment panels 223, 227 can be folded at the respective fold lines 125, 129 into at least partial face-to-face contact with the containers CA1, CA2, CA3. The attachment tabs 227, 231 can be attached to the respective containers CA1, CA2, CA3 with one or more applications of an adhesive such as glue G (FIG. 9). It will be understood that other portions of the carrier 205 can be attached to one or more of the containers with an adhesive without departing from the disclosure.

As shown in FIG. 11, when it is desired to remove one or more of the containers CA1, CA2, CA3 from the carrier 205/package 210, the tear strip 229 can first be engaged by a customer, e.g., at the user engagement feature 230, and at least partially separated from the front attachment panel 223 at the fold line 231 and at respective fold lines 237, depending on a desired number of containers to be removed. Thereafter, the respective containers can be grasped by a customer and pulled away from the carrier 205/package 210 with a force sufficient to cause separation of one or more of the attachment tabs 239 from the back attachment panel 227 at a respective fold line 241.

In this regard, each container removed from the carrier 205/package 210 can be provided with a respective pair of attachment tabs 235, 239 attached thereto, which can optionally be removed by a customer.

The aforementioned arrangement of the carrier 205/package 210 provides attachment features for the containers CA1, CA2, CA3 that are configured for the selective release of the respective containers from the carrier 205/package 210 with advantages similar to those described above with regard to the carriers 105, 105A, 105B, e.g., a controlled removal via the tearing of respective attachment tabs to avoid inadvertent separation of containers from the carrier 205/package 210, tamper evidence, etc.

The additional presence of the tear strip 229 in the carrier 205/package 210 provides an extra measure of tamper evidence and securement for the carrier 205/package 210, as a customer will generally tend to remove the tear strip 229 before proceeding to remove the containers as described above. In one embodiment, a tear strip can be provided between the attachment tabs 239 and the attachment panel 227.

Figure 12:
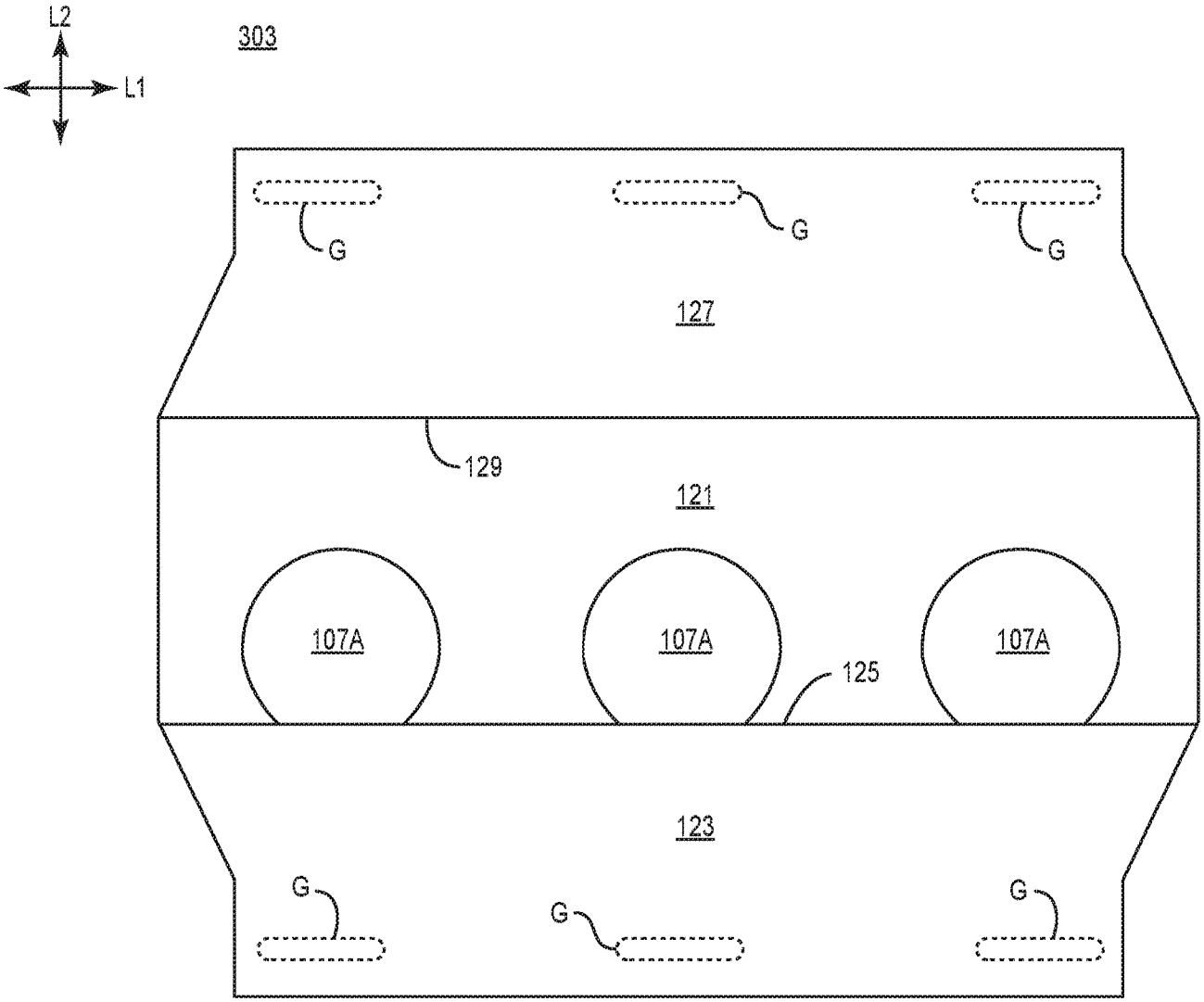
FIG. 12 is a plan view of an outer surface of a blank for forming a carrier and package according to a third exemplary embodiment of the disclosure.

Turning to FIG. 12, a blank for forming a carrier 305 (FIG. 13) according to a third exemplary embodiment of the disclosure is generally designated 303. The blank 303 and the carrier 305 formed therefrom can have one or more features similar to those described above with regard to the blanks 103, 103A, 103B, 203, and carriers 105, 105B, 205, and like or similar features are designated with like or similar reference numerals. The carrier 305 can be provided with one or more containers as a package 310.

In the illustrated embodiment, the blank 303/carrier 305 includes the top panel 121, the front attachment panel 123 foldably connected to the top panel 121 at the fold line 125, and the back attachment panel 127 foldably connected to the top panel 121 at the fold line 129. The blank 303/carrier 305 can include the openings 107A, though one or more of the openings 107A could be omitted without departing from the disclosure, for example, in which the blank 303/carrier 305 is configured for use with containers C1, C2, C3 lacking the protruding upper portion T.

Figure 13:
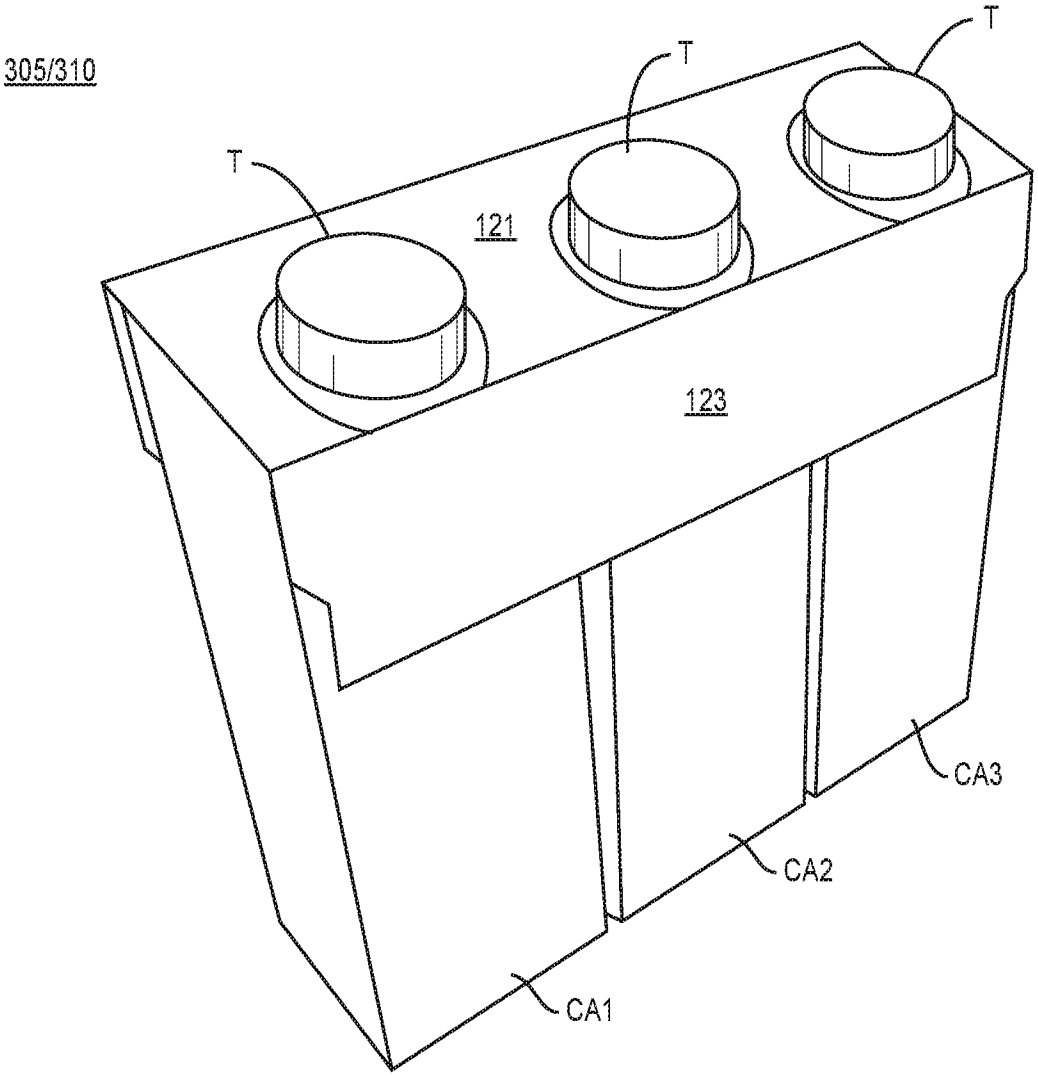
FIG. 13 is a perspective view of the package and carrier formed from the blank of FIG. 12 according to the third exemplary embodiment of the disclosure.

With additional reference to FIG. 13, the carrier 305 can be formed in a similar manner to that described above with regard to the carriers 105, 105A, 105B, 205 e.g., the top panel 121 can be positioned over the containers CA1, CA2, CA3, the attachment panels 123, 227 can be folded at the respective fold lines 125, 129 into at least partial face-to-face contact with the containers and attached thereto with one or more applications of an adhesive such as glue G.

In one embodiment, the glue G can be selected so as to at least partially remain on a respective container when it is removed from the carrier 305/package 310. In another embodiment, the glue G can at least partially remain on the respective attachment panel when a container is removed. In this regard, one or more of the attachment panels 123, 127 and the glue G can form attachment features of the carrier 305/package 310.

The glue G described herein can be, for example, a hot melt adhesive, a high tack glue, an epoxy, a polymeric cement, etc., or combinations thereof. The glue G can have a different arrangement without departing from the disclosure.

In another embodiment, the glue G can have a foam or foamed configuration, e.g., such that pockets of fluids such as gas are interspersed with solid, semi-solid, and/or liquid components of adhesive. In this regard, the glue G can be injected/infused with a fluid, e.g., gaseous, component that influences the glue G to expand from an originally-defined volume, over a change in time, to occupy a larger volume. In one embodiment, the glue G can comprise about 50% solid/semi-solid/liquid adhesive and about 50% gaseous components.

In other embodiments, the glue G can comprise a different ratio of adhesive to gaseous components, for example, about 10% adhesive/about 90% gaseous components, about 20% adhesive/about 80% gaseous components, about 30% adhesive/about 70% gaseous components, about 40% adhesive/about 60% gaseous components, about 60% adhesive/about 40% gaseous components, about 70% adhesive/about 30% gaseous components, about 80% adhesive/about 20% gaseous components, about 90% adhesive/about 10% gaseous components, or other integer or non-integer percentage ratios therebetween. The glue G can be any suitable adhesive without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising a top panel foldably connected to at least one attachment panel; and attachment features for attaching the carrier to the plurality of containers and for selectively separating one or more containers from the carrier, the attachment features being separable from the at least one attachment panel and intersecting at least one free edge of the at least one attachment panel.

2. The carrier of claim 1, wherein the attachment features comprise a plurality of attachment tabs separably connected to the at least one attachment panel at a respective line of weakening.

3. The carrier of claim 2, wherein each line of weakening comprises a longitudinal portion intersecting at least one lateral portion, the lateral portion extending to a first free edge of the at least one attachment panel.

4. The carrier of claim 3, wherein the at least one lateral portion of the line of weakening associated with at least one attachment tab extends to a second free edge of the at least one attachment panel.

5. The carrier of claim 2, wherein the at least one attachment panel is a front attachment panel, and the plurality of panels further comprises a back attachment panel foldably connected to the top panel.

6. The carrier of claim 5, wherein the attachment features comprise a plurality of attachment tabs separably connected to the back attachment panel at a respective line of weakening.

7. The carrier of claim 2, further comprising a plurality of container receiving openings defined in the top panel for at least partially receiving a respective portion of the containers of the plurality of containers.

8. The carrier of claim 7, wherein the plurality of container receiving openings at least partially extends into the at least one attachment panel.

9. The carrier of claim 2, wherein the at least one attachment panel is a back attachment panel, the plurality of panels further comprises a front attachment panel foldably connected to the top panel, and the attachment features further comprise a tear strip separably connected to the front attachment panel.

10. The carrier of claim 9, wherein the attachment features further comprises a plurality of attachment tabs separably connected to the tear strip at a respective line of weakening.

11. The carrier of claim 1, wherein the attachment features are for being adhered to the respective containers of the plurality of containers.

12. A blank for forming a carrier for holding a plurality of containers, the blank comprising:

a plurality of panels comprising a top panel foldably connected to at least one attachment panel; and attachment features for attaching the carrier formed from the blank to the plurality of containers and for selectively separating one or more containers from the carrier formed from the blank, the attachment features being separable from the at least one attachment panel and intersecting at least one free edge of the at least one attachment panel.

13. The blank of claim 12, wherein the attachment features comprise a plurality of attachment tabs separably connected to the at least one attachment panel at a respective line of weakening.

14. The blank of claim 13, wherein each line of weakening comprises a longitudinal portion intersecting at least one lateral portion, the lateral portion extending to a first free edge of the at least one attachment panel.

15. The blank of claim 14, wherein the at least one lateral portion of the line of weakening associated with at least one attachment tab extends to a second free edge of the at least one attachment panel.

16. The blank of claim 13, wherein the at least one attachment panel is a front attachment panel, and the plurality of panels further comprises a back attachment panel foldably connected to the top panel.

17. The blank of claim 16, wherein the attachment features comprise a plurality of attachment tabs separably connected to the back attachment panel at a respective line of weakening.

18. The blank of claim 13, further comprising a plurality of container receiving openings defined in the top panel for at least partially receiving a respective portion of the containers of the plurality of containers when the carrier is formed from the blank.

19. The blank of claim 18, wherein the plurality of container receiving openings at least partially extends into the at least one attachment panel.

20. The blank of claim 13, wherein the at least one attachment panel is a back attachment panel, the plurality of panels further comprises a front attachment panel foldably connected to the top panel, and the attachment features further comprise a tear strip separably connected to the front attachment panel.

21. The blank of claim 20, wherein the attachment features further comprises a plurality of attachment tabs separably connected to the tear strip at a respective line of weakening.

22. A method of forming a carrier for holding a plurality of containers, the method comprising:

obtaining a blank comprising a plurality of panels comprising a top panel foldably connected to at least one attachment panel, the blank further comprising attachment features, the attachment features being separable from the at least one attachment panel and intersecting at least one free edge of the at least one attachment panel;

at least partially folding the plurality of panels to form the carrier; and attaching the attachment features to the plurality of containers such that the attachment features are configured for selectively separating one or more containers from the carrier.

23. The method of claim 22, further comprising separating at least one attachment feature from the at least one attachment panel.

24. The method of claim 23, wherein the attachment features comprise a plurality of attachment tabs separably connected to the at least one attachment panel at a respective line of weakening.

25. The method of claim 24, wherein each line of weakening comprises a longitudinal portion intersecting at least one lateral portion, the lateral portion extending to a first free edge of the at least one attachment panel.

26. The method of claim 25, wherein the at least one lateral portion of the line of weakening associated with at least one attachment tab extends to a second free edge of the at least one attachment panel.

27. The method of claim 24, wherein the at least one attachment panel is a front attachment panel, and the plurality of panels further comprises a back attachment panel foldably connected to the top panel.

28. The method of claim 27, wherein the attachment features comprise a plurality of attachment tabs separably connected to the back attachment panel at a respective line of weakening.

29. The method of claim 24, further comprising a plurality of container receiving openings defined in the top panel for at least partially receiving a respective portion of the containers of the plurality of containers.

30. The method of claim 29, wherein the plurality of container receiving openings at least partially extends into the at least one attachment panel.

31. The method of claim 24, wherein the at least one attachment panel is a back attachment panel, the plurality of panels further comprises a front attachment panel foldably connected to the top panel, and the attachment features further comprise a tear strip separably connected to the front attachment panel.

32. The method of claim 31, wherein the attachment features further comprises a plurality of attachment tabs separably connected to the tear strip at a respective line of weakening.

33. The method of claim 23, wherein attaching the attachment features comprises adhering the attachment features to respective containers of the plurality of containers.

34. A package, comprising:

a plurality of panels comprising a top panel foldably connected to at least one attachment panel; and attachment features attaching the carrier to the plurality of containers such that one or more containers are selectively separable from the carrier, the attachment features being separable from the at least one attachment panel and intersecting at least one free edge of the at least one attachment panel.

35. The package of claim 34, wherein the attachment features comprise a plurality of attachment tabs separably connected to the at least one attachment panel at a respective line of weakening.

36. The package of claim 35, wherein each line of weakening comprises a longitudinal portion intersecting at least one lateral portion, the lateral portion extending to a first free edge of the at least one attachment panel.

37. The package of claim 36, wherein the at least one lateral portion of the line of weakening associated with at least one attachment tab extends to a second free edge of the at least one attachment panel.

38. The package of claim 35, wherein the at least one attachment panel is a front attachment panel, and the plurality of panels further comprises a back attachment panel foldably connected to the top panel.

39. The package of claim 38, wherein the attachment features comprise a plurality of attachment tabs separably connected to the back attachment panel at a respective line of weakening.

40. The package of claim 35, further comprising a plurality of container receiving openings defined in the top panel at least partially receiving a respective portion of the containers of the plurality of containers.

41. The package of claim 40, wherein the plurality of container receiving openings at least partially extends into the at least one attachment panel.

42. The package of claim 35, wherein the at least one attachment panel is a back attachment panel, the plurality of panels further comprises a front attachment panel foldably connected to the top panel, and the attachment features further comprise a tear strip separably connected to the front attachment panel.

43. The package of claim 42, wherein the attachment features further comprises a plurality of attachment tabs separably connected to the tear strip at a respective line of weakening.

44. The package of claim 34, wherein the attachment features are adhered to the respective containers of the plurality of containers.

* * * * *